US005570543A

United States Patent [19]

Bishop

[11] Patent Number: 5,570,543

[45] Date of Patent: Nov. 5, 1996

[54] ADJUSTABLE, REMOVABLE CHILD WINDOW GUARD

[75] Inventor: Alvin Bishop, Hamilton, Canada

[73] Assignee: Steel Creek Concepts, Inc., Ontario, Canada

[21] Appl. No.: 197,195

[22] Filed: Feb. 16, 1994

[51] Int. Cl.[6] ..... E05C 21/02

[52] U.S. Cl. ..... 49/465; 49/55; 160/216; 160/225

[58] Field of Search ..... 49/465, 463, 464, 49/55, 57; 160/216, 225, 228

[56] References Cited

U.S. PATENT DOCUMENTS

| | | | |
|---|---|---|---|
| 1,186,139 | 6/1916 | Shipley | 49/55 X |
| 1,242,413 | 10/1917 | Archard | 160/228 X |
| 1,532,628 | 4/1925 | Mackenzie | 49/57 X |
| 1,813,652 | 7/1931 | Abrams et al. | 160/225 |
| 1,962,569 | 6/1934 | Miller | 160/225 |
| 3,163,205 | 12/1964 | Gottlieb | 49/55 X |
| 4,944,117 | 7/1990 | Gebhard et al. | 49/55 |
| 5,052,461 | 10/1991 | Stern | 160/216 X |
| 5,272,840 | 12/1993 | Knoedler et al. | 49/55 X |

*Primary Examiner*—Philip C. Kannan

[57] ABSTRACT

An adjustable, removable child window guard includes a first panel, a second panel and a bolt and slot arrangement for slidably connecting the first panel to the second panel. A locking mechanism requiring two-handed operation to permit the relative sliding movement of the first and second panels is provided for selectably permitting and inhibiting relative sliding movement of the first and second panels. The window guard includes two sets of teeth affixed to the first panel and two sets of tooth engagement means mounted on the second panel. L-shaped brackets are provided to permit non-intrusive mounting of the window guard in a window frame.

16 Claims, 4 Drawing Sheets

24
12
36
10
35
30
34
22
32

18
30
74
26
82
84
78
70
80

10
12
36
18
30
74
26
82
84
78
29
34
70
80
79
28
72
76
20
32

ADJUSTABLE, REMOVABLE CHILD WINDOW GUARD

FIELD OF INVENTION

This invention relates in general to window guards and more particularly to an adjustable, removable window guard for preventing children from accidentally falling from a window.

BACKGROUND OF THE INVENTION

Windows which may be opened and which are accessible to young children pose a risk to children in that they may climb through or fall through such windows. Such a risk is particularly great in apartments in high-rise buildings. Some cities require that parents of young children install protective devices in windows which are accessible to the children to prevent the children from falling from, or climbing through, such windows.

Prior art devices designed to prevent children from climbing or falling through a window include devices with metal bars which are intended to be screwed, or affixed in some other manner, to a window and which are not designed to be easily removed. Such prior art devices are intrusive and undesirable because they result in screw holes or the like being made in the frame of the window. In addition, firefighters object to such devices as they hamper access to the building through the window should such access be necessary during a fire or similar emergency.

Child window guards which include metal bars must, in some cases be custom fitted to any given window. In addition, such window guards are aesthetically unpleasing.

Thus a child window guard which may be easily installed in a non-intrusive manner on different sized windows and which may be easily removed is desirable.

SUMMARY OF THE INVENTION

An object of one aspect of the present invention is to provide an improved child window guard.

In accordance with one aspect of the present invention there is provided a child window guard having a first panel, a second panel, a means for slidably connecting the first panel to the second panel, a locking means for selectively permitting and inhibiting relative sliding movement of the first and second panels, and a means for non-intrusive mounting of the window guard in a window frame, wherein at least one of the first panel or second panels comprises a portion which permits the passage of air but which is of sufficient strength to prevent the passage of a child through the at least one of the first or second panels and wherein the locking means requires two-handed operation to permit relative sliding movement of the first and second panels.

Advantageously, the locking means comprises first and second sets of teeth fixed to the first panel, each set spaced apart from the other and arranged along the axis of relative sliding motion of the first and second panels, first and second tooth engagement means mounted on the second panel, wherein the first tooth engagement means is movable between a first engaged position with respect to the first set of teeth and a second disengaged position, and wherein the second tooth engagement means is movable between a first engaged position with respect to the second set of teeth and a second disengaged position, wherein the first and second tooth engagement means are independently biased towards their respective engaged positions.

Advantages of the present invention are that the window guard may be easily fitted to a given window frame and mounted in the window frame without intrusive attachment means. The window guard may only be removed by operating a release mechanism requiring two handed operation which prevents unwanted removal by small children.

An advantage of an embodiment of the present invention is that the window guard may be made of a material which may be shaped in an aesthetically pleasing manner. A further advantage of an embodiment of the invention is that the window guard may be removed by a firefighter seeking access to a room by way of a window.

BRIEF DESCRIPTION OF THE DRAWINGS

A detailed description of the preferred embodiment is provided herein below with reference to the following drawings in which.

DETAILED DESCRIPTION OF THE PREFERRED EMBODIMENT

Figure 1:
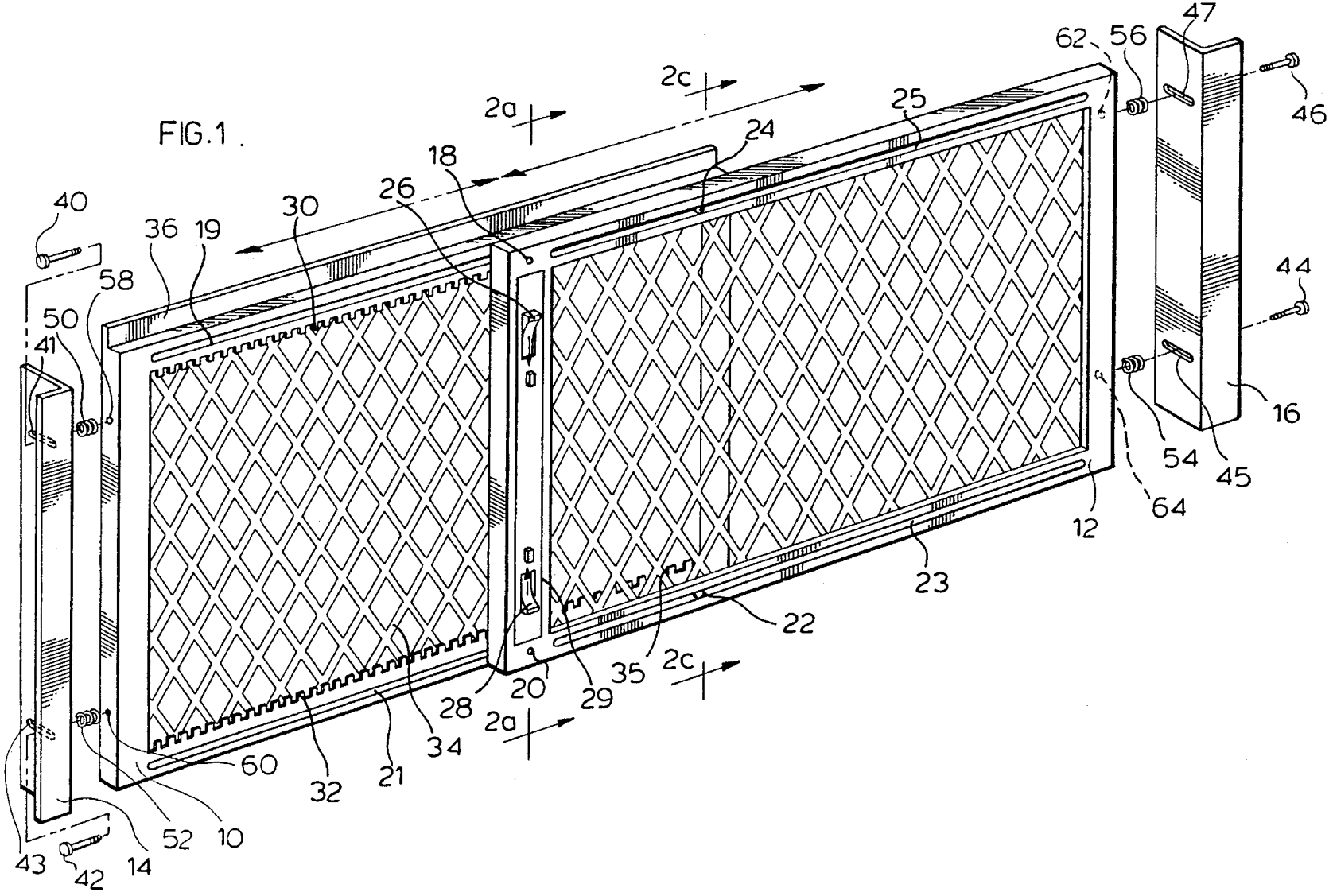
FIG. 1, in a partially exploded perspective view, illustrates a child window guard in accordance with the preferred embodiment of the present invention.

Referring to FIG. 1, there is illustrated in a partially exploded perspective view, a child window guard in accordance with the preferred embodiment of the present invention. The child window guard includes a first panel 10 and second panel 12. Affixed to one end each of panels 10 12, are L-shaped brackets 14, 16.

Panels 10, 12 are maintained in sliding engagement by a set of bolts 18, 20, 22, 24.

Locking mechanisms 26, 28 are mounted in panel 12 and engage sets of teeth 30, 32 of panel 10, respectively. Panels 10, 12 have grill portions 34, 35. The grill potions 34, 35 may have a design different than that shown in FIG. 1 but must be sufficiently strong to prevent a child from being able to break the grill portions 34, 35 by pushing or falling against them. Preferably, at least one of, and advantageously both of, the grill portions 34, 35 have interstices of sufficient size to permit light and air to pass through the grill portions of the window guard. A sheet of plexiglass or similar transparent or translucent material, with holes cut in the sheet, may be used for the grill portions 34, 35.

Panel 10 has a lip 36 which runs along the outer upper edge of the panel and which is intended to engage a sash of a window.

Panels 10, 12 are slidably engaged by means of bolts 18 and 20 which extend through slots 19 and 21 in panel 10 and by bolts 22 and 24 which extend through slots 23 and 25 in panel 12. The head of each bolt has a diameter greater than the width of the slot in which it moves. Each bolt is affixed to one panel and extends through a slot of the other panel. Thus bolt 18 is affixed to panel 12 and slides through slot 19 of panel 10. Bolt 24 is affixed to panel 10 and slides through slot 25 of panel 12.

L-shaped brackets 14, 16 are affixed to panels 10, 12, respectively, bolts 40, 42, 44 and 46 are provided and are intended to be introduced through slots 41, 43, 45 and 47 in brackets 14 and 16, respectively. Springs 50, 52, 54 and 56 are mounted on bolts 40, 42, 44 and 46. The bolts are then affixed to panels 10 and 12 by threaded bores 58, 60, 62 and 64.

Figure 2C:
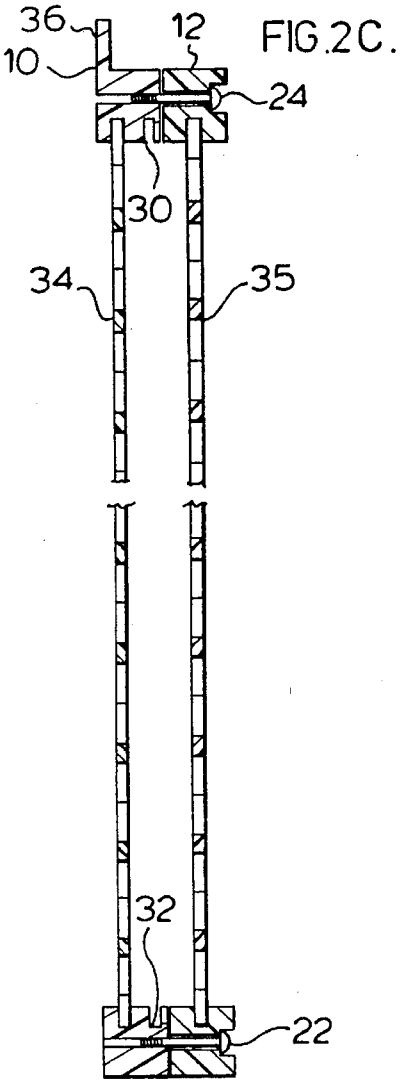
FIG. 2*c*, in a cross-sectional view, illustrates the child window guard of FIG. 1 along lines 2*c*—2*c;*
Figure 2B:
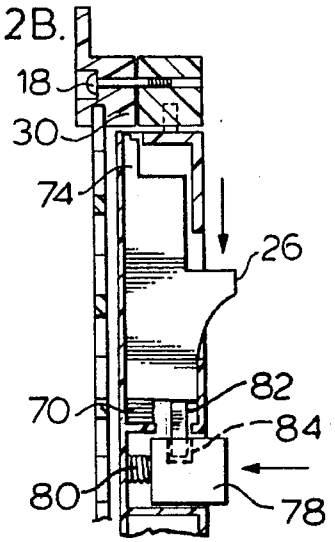
FIG. 2*b*, in a cross-sectional view, illustrates the child window guard of FIG. 1 along lines 2*a*—2*a*, with the locking mechanism in a disengaged position.
Figure 2A:
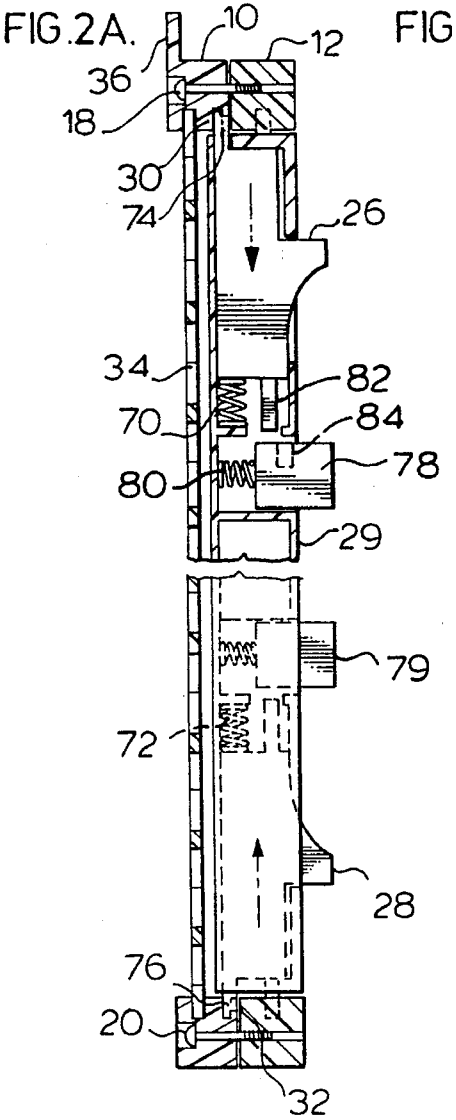
FIG. 2*a*, in a cross-sectional view, illustrates the child window guard of FIG. 1 in a sectional view along lines 2*a*—2*a*, with the locking mechanism in an engaged position.

In FIG. 2*a*, the child window guard of FIG. 1 is illustrated in a sectional view along line 2*a*—2*a*. FIG. 2*a* shows panel 10 held in sliding relation to panel 12 by bolts 18, 20. FIG. 2*a* shows locking mechanisms 26, 28 which contain springs 70, 72. The springs bias the locking mechanisms outwardly with respect to panel 12. Locking mechanism 26 has a projecting member 74 and locking member 28 has a projecting member 76. Members 74, 76 are dimensioned in order to fit within teeth sets 30, 32. Locking members 26, 28 are mounted in end portion 29 of panel 12 and are able to slide up and down within end portion 29 of panel 12. In FIG. 2*a* locking mechanism 26 is shown in an extended position such that projecting member 74 is engaged in teeth set 30.

Release member 78 is shown in locking mechanism 26 biased outwardly by spring 80 in FIG. 2A. Slot 84 in release member 78 is out of alignment with tongue 82 of locking mechanism 26. In this position projecting member 74 cannot be retracted.

In FIG. 2*b*, the child window guard of FIG. 1 is illustrated in a cross-sectional view along line 2*a*—2*a* with locking mechanism 26 in a retracted position such that projecting member 74 is disengaged with teeth set 30. Release member 78 is shown in a depressed position in FIG. 2B, with spring 80 compressed. As a result slot 84 is aligned with tongue 82 to permit locking mechanism 26 to be retracted.

In FIG. 2*c*, the child window guard of FIG. 1 is illustrated in a cross-sectional view along line 2*c*—2*c* of FIG. 1. FIG. 2*c* shows panels 10, 12 held in sliding relation by bolts 22, 24. Grill portions 34, 35 of panel members 10, 12, respectively, are shown as spaced apart from each other.

Figure 3:
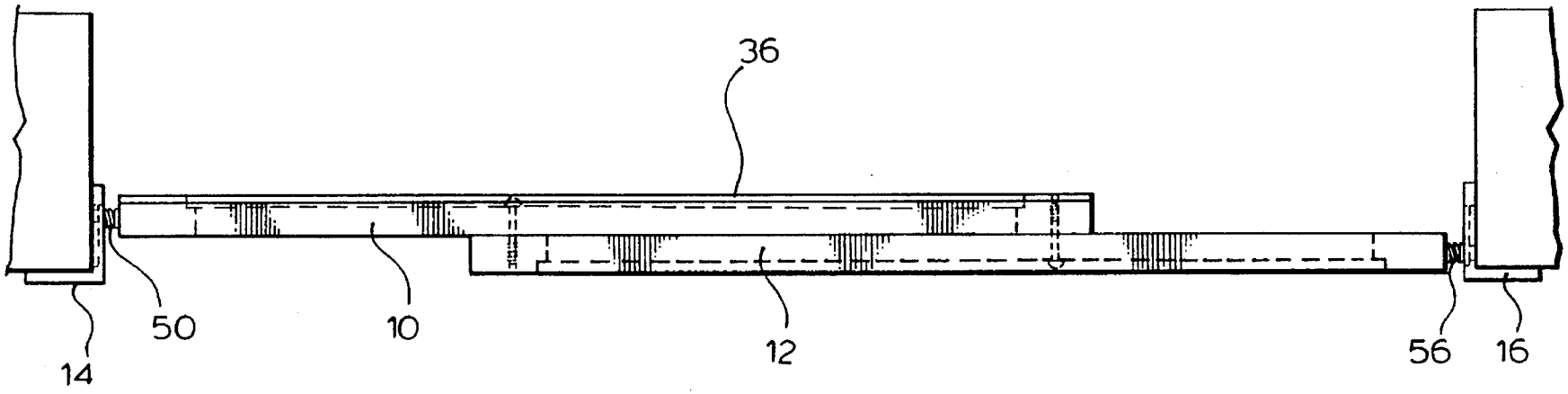
FIG. 3, in a plan view, illustrates the child window guard of FIG. 1 in place in a window frame.

In FIG. 3, the child window guard of FIG. 1 is illustrated in plan view, in place in a window frame. FIG. 3 shows the L-shaped brackets 14 and 16 in place abutting a window frame. Springs 50 and 56 are shown exerting an outward biasing force against the L-shaped brackets 14, 16, respectively. It is contemplated that springs 50, 56 may be enclosed in a housing (not shown) to prevent access to the springs by children. The lip 36 is shown on panel 10 on the outside upper edge of the window guard.

Figure 4:
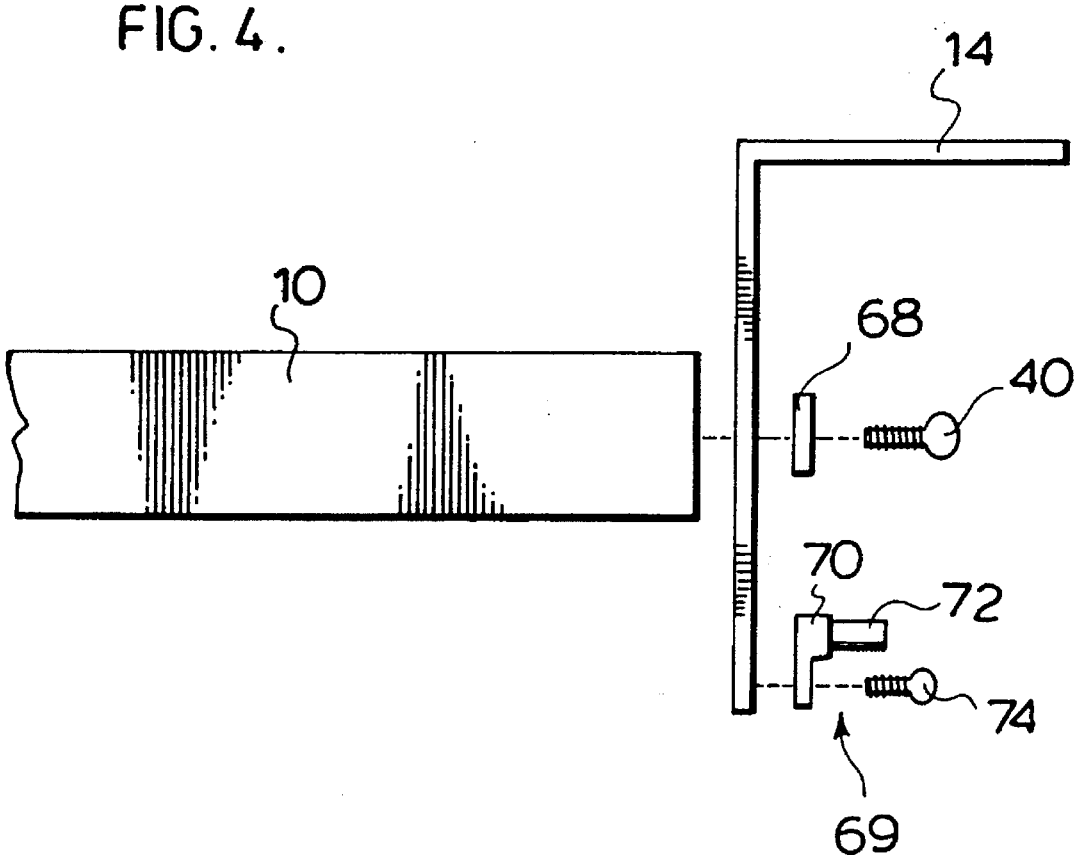
FIG. 4, in a plan view, illustrates an alternative means for securing the window guard of the preferred embodiment of the invention to the window frame.

In FIG. 4, there is illustrated, in a plan view, an alternative means for securing the window guard of the preferred embodiment of the invention to the window frame. The L-shaped bracket 14 is secured to panel 10 by means of bolt 40. In the alternative shown in FIG. 4, there is no spring 50, as shown in FIG. 1. The bolt 40 has a washer 68 which is placed between the head of bolt 40 and L-shaped bracket 14. The L-shaped bracket 14 may be adjusted to correspond to the geometry of the appropriate window frame. Once the adjustment is made, the bolt 40 (and corresponding bolt 42, not shown in FIG. 4) will be tightened to fix L-shaped bracket 14 in place relative to the panel 10.

FIG. 4 shows biasing mechanism 69 which is affixed to the L-shaped bracket 14 at the open end of the L-shaped bracket on the interior of the "L". The biasing mechanism 69 has base portion 70 and extending member 72. The biasing mechanism is attached to the L-shaped bracket 14 by bolt 74. The extending portion 72 encloses a spring which biasses the extending member 72 in an extended position. The extending member 72 may also be retracted partially within base portion 70. The biasing mechanism may also be replaced with short rubber knobs. Optionally, one of the L-shaped brackets 14, 16 may have biasing mechanisms 69, while the other has rubber knobs. The function of the biasing mechanisms and the rubber knobs is to assist in retaining the L-shaped brackets in the window frame. The biasing mechanisms and the knobs are intended to be inserted into or cooperate with the grooves formed in the inner surfaces of a window frame.

In operation, the child window guard of the invention can be quickly installed in, or removed from, a window without the need for screws or other intrusive attachment devices to maintain the child window guard in the window frame. How this is achieved is explained here below with reference to FIGS. 1–3.

As may be seen with respect to FIG. 1, the bolts 18, 20, 22, 24 are each secured to one of panels 10 and 12 and each slides through one of slots 19, 21, 23 and 25, found in panels 10, 12. As a result, the window guard is able to be adjusted to fit windows of varying widths. Locking mechanisms 26, 28 are provided to lock the window guard into a desired configuration.

The L-shaped brackets 14, 16 have slots 41, 43 and 45, 47, respectively which permit the brackets to be adjusted so that the window guard will fit windows of differing depths.

As may be seen in FIGS. 2A and 2B, the locking mechanisms 26, 28 have projecting members 74, 76 which are dimensioned to engage teeth sets 30, 32 found on panel 10 of the window guard. Springs 70, 72 bias the locking mechanisms 26, 28 in a position such that projecting members 74, 76 are engaged with teeth sets 30 and 32.

In order to move panel 10 relative to panel 12, both locking mechanisms 26, 28 must be simultaneously moved inwardly against the biasing force of springs 70, 72 to retracted positions. In order to allow the locking mechanisms to retract, release members 78, 79 must be depressed. Thus the effective width of the window guard may only be altered by two-handed operation of the locking mechanisms 26, 28.

In order to place the window guard in a window, the sash of the window must be raised. The L-shaped brackets 14, 16 are then placed against the inside corner of the window frame at the lower part of the window frame. L-shaped brackets 14, 16 are shorter then the height of the window guard and therefore the window guard may rest in grooves found in a windowsill designed to receive the sash of the window. The panels 10, 12 are made free for relative movement by pushing locking mechanisms 78, 79 inwardly and sliding the locking mechanisms so that the projecting members 74, 76 retract from teeth sets 30, 32. The panels 10, 12 may then be adjusted to permit L-shaped brackets 14 and 16 to engage the inner corners of the window frame. Springs 50, 52, 54, 56, are compressed as panels 10, 12 are moved apart to increase the effective width of the window guard. The panels 10, 12 are moved so as to increase the width of the window guard until a snug fit is achieved with respect to the window frame. The locking mechanisms 26, 28 are then permitted to return to an extended position whereby extending members 74, 76 engage teeth sets 30, 32, respectively. The sash of the window may then be lowered such that lip 36 of panel 10 is on the exterior side of the sash.

The L-shaped brackets 14, 16 prevent the window guard from being pushed outward by a child. Having the window guard seated in a groove in the window sill, as well as the position of lip 36 on the exterior of the window sash, prevent the window guard from being pulled inwardly, as does the biasing of the L-shaped brackets against the window frame by springs 50, 52, 54, 56.

In the alternative arrangement shown in FIG. 4, the biasing mechanism assists in maintaining the window guard in position in the window.

In order to remove the child window guard from the window frame, the locking mechanisms 78, 79 must both be depressed and locking mechanisms 26, 28 pushed inwardly and the panels 10, 12 moved so as to reduce the effective width of the child window guard. Either before or after this operation, the sash of the window is raised to a level higher than the top edge of lip 36. Once the sash has been raised and the window guard adjusted to have a more narrow effective width, the window guard may be easily removed from the window.

The child window guard of the preferred embodiment may be manufactured of injection moulded plastic. The grill portions, 34, 35 may incorporate other designs than those shown in the Figures of the preferred embodiment. The L-shaped brackets 14, 16 may be manufactured of plastic or light weight metal.

In summary, a child window guard is provided which is adjustable and may be removed only by two-handed operation of the locking mechanism.

Other variations of and modifications of the invention are possible. For example, the mechanism to provide a sliding relationship between panels 10 and 12 may be carried out by means other than the slot and bolt arrangement disclosed above. All such modifications or variations are believed to be within the sphere and scope of the invention as defined by the claims appended hereto.

I claim:

1. A child window guard comprising a first panel, a second panel, means for slidably connecting the first panel to the second panel, locking means for selectively permitting and inhibiting relative sliding movement of the first and second panels, means for non-intrusive mounting of the window guard in a widow frame, and wherein at least one of the first panel or second panels comprises a portion which permits the passage of air but which is of sufficient strength to prevent the passage of a child through the at least one of the first or second panels and wherein the locking means comprises two spaced apart release mechanisms, each biased to inhibit relative sliding movement of the first and second panels such that the locking means requires two-handed operation to permit relative sliding movement of the first and second panels.

2. The window guard claimed in claim 1 in which the locking means comprises first and second sets of teeth fixed to the first panel, each set spaced apart from the other and arranged along the axis of relative sliding motion of the first and second panels, first and second tooth engagement means mounted on the second panel, wherein the first tooth engagement means is movable between a first engaged position with respect to the first set of teeth and a second disengaged position, and wherein the second tooth engagement means is movable between a first engaged position with respect to the second set of teeth and a second disengaged position, and wherein the first and second tooth engagement means are independently biased towards their respective engaged positions.

3. The window guard claimed in claim 1 in which the means for non-intrusive mounting of the window guard in a window frame comprises a first L-shaped bracket mounted on the end of the first panel remote from the second panel, and a second L-shaped bracket mounted on the end of the second panel remote from the first panel, the L-shaped brackets being biased outwardly from the said first and second panels, respectively, wherein one arm of each of the L-shaped brackets is parallel to the axis of relative sliding motion of the first and second panels and the other arm of the first L-shaped bracket is adjacent the end of the first panel upon which it is mounted, and the other arm of the second L-shaped bracket is adjacent the end of the second panel upon which it is mounted.

4. The window guard claimed in claim 1 in which the means for non-intrusive mounting of the window guard in a window frame comprises a first L-shaped bracket mounted on the end of the first panel remote from the second panel, and a second L-shaped bracket mounted on the end of the second panel remote from the first panel, the positions of the L-shaped brackets being adjustable with respect to the first and second panels, wherein one arm of each of the L-shaped brackets is parallel to the axis of relative sliding motion of the first and second panels and the other arm of the first L-shaped bracket is adjacent the end of the first panel upon which it is mounted, and the other arm of the second L-shaped bracket is adjacent the end of the second panel upon which it is mounted and wherein a projecting means is secured to the other arm of the first L-shaped bracket so as to engage a portion of a window frame.

5. The window guard claimed in claim 4 in which the projecting means secured to the other arm of the first L-shaped bracket so as to engage a portion of a window frame comprises a movable member biased in an extended position.

6. The window guard claimed in claim 1 in which the first panel comprises a lip which extends along a corner of the upper edge of the first panel which is remote from the second panel.

7. The window guard claimed in claim 1 in which the first panel comprises first and second slots which extend along the axis of relative slidable movement of the first and second panels, and in which the means for slidably connecting the first panel to the second panel comprises first and second bolts secured to the second panel and extending through the first and second slots in the first panel, respectively, wherein the heads of the bolts have a circumference larger than the width of the slots.

8. The window guard claimed in claim 1 in which the portion which permits the passage of air but which is of sufficient strength to prevent the passage of a child through the portion is made from injection molded plastic.

9. The window guard claimed in claim 1 in which the portion which permits the passage of air but which is of sufficient strength of prevent the passage of a child through the portion is made from plexiglass having holes cut in the plexiglass.

10. A child window guard comprising a first panel, a second panel, means for slidably connecting the first panel to the second panel, locking means for selectively permitting and inhibiting relative sliding movement of the first and second panels, means for non-intrusive mounting of the window guard in a window frame, wherein at least one of the first panel or the second panels comprises a portion which permits the passage of air but which is of sufficient strength to prevent the passage of a child through the at least one of the first or second panels and wherein the means for non-intrusive mounting of the window guard in a window frame comprises a first L-shaped bracket mounted on the end of the first panel remote from the second panel, a second L-shaped bracket mounted on the end of the second panel remote from the first panel, the L-shaped brackets being biased outwardly from the first and second panels respectively, wherein one arm of each of the L-shaped brackets is parallel to the axis of relative sliding motion of the first and second panels and the other arm of the first bracket is adjacent to the end of the first panel upon which it is mounted, and the other arm of the L-shaped bracket is adjacent to the end of the second panel upon which it is mounted.

11. The window guard claimed in claim 10 in which the positions of the L-shaped brackets are adjustable with respect to the first and second panels and wherein a projecting means is secured to an arm of at least one L-shaped bracket so as to engage a portion of a window frame.

12. The window guard claimed in claim 11 in which the projecting means comprises a moveable member biased in an extended position.

13. The window guard claimed in claim 10 in which the first panel comprises a lip which extends along a corner of the upper edge of the first panel which is remote from the second panel.

14. The window guard claimed in claim 10 in which the first panel comprises first and second slots which extend along the axis of relative slidable movement of the first and second panels, and in which the means for slidably connecting the first panel to the second panel comprises first and second bolts secured to the second panel and extending through the first and second slots in the first panel, respectively, wherein the heads of the bolts have a circumference larger than the width of the slots.

15. The window guard claimed in claim 10 in which the portion which permits the passage of air but which is of sufficient strength to prevent the passage of a child through the portion is made from injection molded plastic.

16. The window guard claimed in claim 10 in which the portion which permits the passage of air but which is of sufficient strength to prevent the passage of a child through the portion is made from plexiglass having holes cut in the plexiglass.

* * * * *